US006138421A

United States Patent [19]

Grigsby

[11] Patent Number: 6,138,421

[45] Date of Patent: Oct. 31, 2000

[54] FOUNDATION ANCHOR BOLT POSITIONING APPARATUS

[76] Inventor: Brian J. Grigsby, 2457 Liberty Rd., Stow, Ohio 44224

[21] Appl. No.: 09/102,994

[22] Filed: Jun. 22, 1998

[51] Int. Cl.[7] ..... E04B 1/06

[52] U.S. Cl. ..... 52/293.2; 52/712

[58] Field of Search ..... 52/293.2, 285.2, 52/712, 105, 713–715, 293.3

[56] References Cited

U.S. PATENT DOCUMENTS

| | | | |
|---|---|---|---|
| 3,537,220 | 11/1970 | Ellis | 52/225 |
| 4,726,567 | 2/1988 | Greenberg | 256/19 |
| 5,138,808 | 8/1992 | Bengtson et al. | 52/204 |
| 5,664,389 | 9/1997 | Williams | 52/677 |

*Primary Examiner*—Richard Chilcot
*Attorney, Agent, or Firm*—Oldham & Oldham Co., L.P.A.

[57] ABSTRACT

The invention relates to an apparatus for supporting and positioning an anchor bolt within a masonry construction block wall to allow the frame of a building to be secured or tied to the anchor bolt. Masonry construction block walls are typically constructed so that the hollow vertical cores in the construction blocks are partially aligned so as to form a hollow channel or conduit traveling down through the wall. The apparatus includes a base designed to fit within a construction block wall to provide a support to which the lower end of an anchor bolt may be attached by clips or otherwise. This allows the upper end of the anchor bolt to extend upward through the channel and above the top layer of blocks. The base also serves to plug or fill the channel formed by the cores in the blocks so as to facilitate the process of permanently securing the anchor bolt by pouring cement into the channel around the anchor bolt. The apparatus may also include an external indicator which extends external to the wall so as to provide a visual indication of the presence and location of the apparatus within the wall and other aspect to facilitate its use.

19 Claims, 5 Drawing Sheets

FOUNDATION ANCHOR BOLT POSITIONING APPARATUS

FIELD OF INVENTION

The present invention relates generally to building construction and more specifically to an apparatus for supporting and positioning an anchor bolt within a masonry construction block foundation wall to allow the frame of a building to be secured or tied to the anchor bolt.

BACKGROUND OF THE INVENTION

Foundations of houses and other buildings are commonly constructed from construction blocks which are also commonly referred to as cinder blocks. These blocks are manufactured having two hollow cores which extend through the block in a vertical orientation when the blocks are properly stacked. The cores are separated by a cross-member which is located at the midsection of the block.

Anchor bolts secured in a construction block or cinder foundation block wall have long been used to secure or tie the frame of a building or house to the construction block foundation. In the past, the use of such bolts involved inserting a bolt in the space between two abutting construction blocks of the top layer or course of blocks so that the lower end of the bolt rested on the cross-member of the block below with the upper end of the bolt extending above the top layer of blocks. The anchor bolt was permanently secured by pouring cement around the bolt. Once the bolt was cemented in position, the frame of the structure could then be bolted to this upper end.

Although this method worked fairly well for positioning an anchor bolt through only one layer of construction blocks, various problems were still present. For example, because the bolts are randomly positioned by a worker, properly positioning all of the bolts so that their upper ends extend through the centerline of the sill or frame is difficult. Also, it is difficult to position the bolts substantially vertically as required. Finally, because the blocks in such a wall are offset or staggered, the cross-member of the block below the top layer prevented the anchor bolt from being inserted through more than one layer of blocks.

Recent natural disasters including earthquakes, floods, and hurricanes have exposed the inadequacies of the above method of securing an anchor bolt in a construction block wall. In many cases, anchor bolts anchored through only one layer of construction blocks were ripped from their position in the wall. This has caused enactment of ordinances requiring anchor bolts to be secured so that their length travels through at least two layers of a construction block wall. In addition, even when not required by law, builders have been exposed to liability for securing anchor bolts through less than two layers of blocks.

To position an anchor bolt so that it extends through two courses of blocks, it is now common to pass the bolt down through the partially aligned cores of two layers of stacked blocks and subsequently secure the bolt by pouring cement down into the cores. This results in the bolt being secured so that its length travels through the required two layers of blocks.

Because the bolt must be inserted down into small openings through two layers of blocks, it is difficult and time consuming to properly position the bolt in the center of the wall as required. It is also difficult and time consuming to maintain the bolt in its required vertical position while cement is poured into the cores around the bolt. Also, because the cores in the block are somewhat aligned down through the entire height of the wall, there is no base upon which to rest the bottom of the bolt while cement is poured around the bolt. Finally, the fact that the cores are somewhat aligned also results in the waste of a large amount of cement which runs down through the cores below the bolt before filling the desired area around the bolt.

Builders have attempted to solve the above problems by filling the cores below the top two courses with sand, empty bags and other debris to provide some type of base or plug upon which to rest the bottom of the bolt and to prevent a large amount of cement from running down through the entire height of the wall. These attempts at solving the above problems have been unsuccessful and unsatisfactory.

In addition, because cement is poured around the anchor bolt to permanently secure it, building inspectors and others have found it difficult to verify that the anchor bolts do in fact extend down through at least two layers of blocks as required. Unless the inspectors observed the entire process of securing the bolts, the nature of a construction block wall makes it impossible to determine the depth to which the bolts are secured.

SUMMARY OF THE INVENTION

Based upon the foregoing, it is a main object of the present invention to provide a new and effective means for positioning and securing an anchor bolt within a construction block wall.

It is a further object of the invention to provide an indication, external to a construction block wall, that the apparatus is properly disposed at a predetermined position within said wall.

To achieve these and other objects and in accordance with the purpose of the invention, the invention comprises a base having means to be supported on or within a construction block, and attachment means for securing an anchor bolt to the base in a predetermined position. The apparatus may further comprise indicator means, attached to said base for indicating external to a construction block wall, the presence of the invention within said wall.

BRIEF DESCRIPTION OF THE DRAWINGS

These and additional objects and advantages of the present invention will be further understood in reading the detailed description which follows in conjunction with the drawings, wherein.

DETAILED DESCRIPTION OF THE INVENTION

Figure 2:
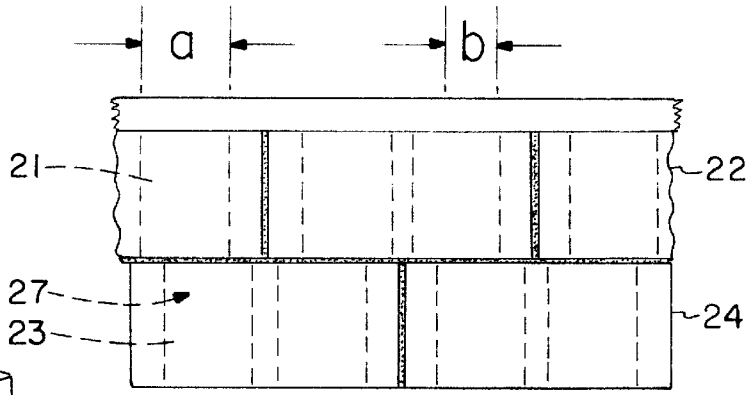
FIG.-2 PRIOR ART
FIG. 2 is a diagrammatic elevational view of a conventional foundation wall.

The invention will be described in detail with reference to the preferred embodiment thereof. Like elements are identified by like reference numerals, where possible, throughout the drawings and specification.

Figure 1:
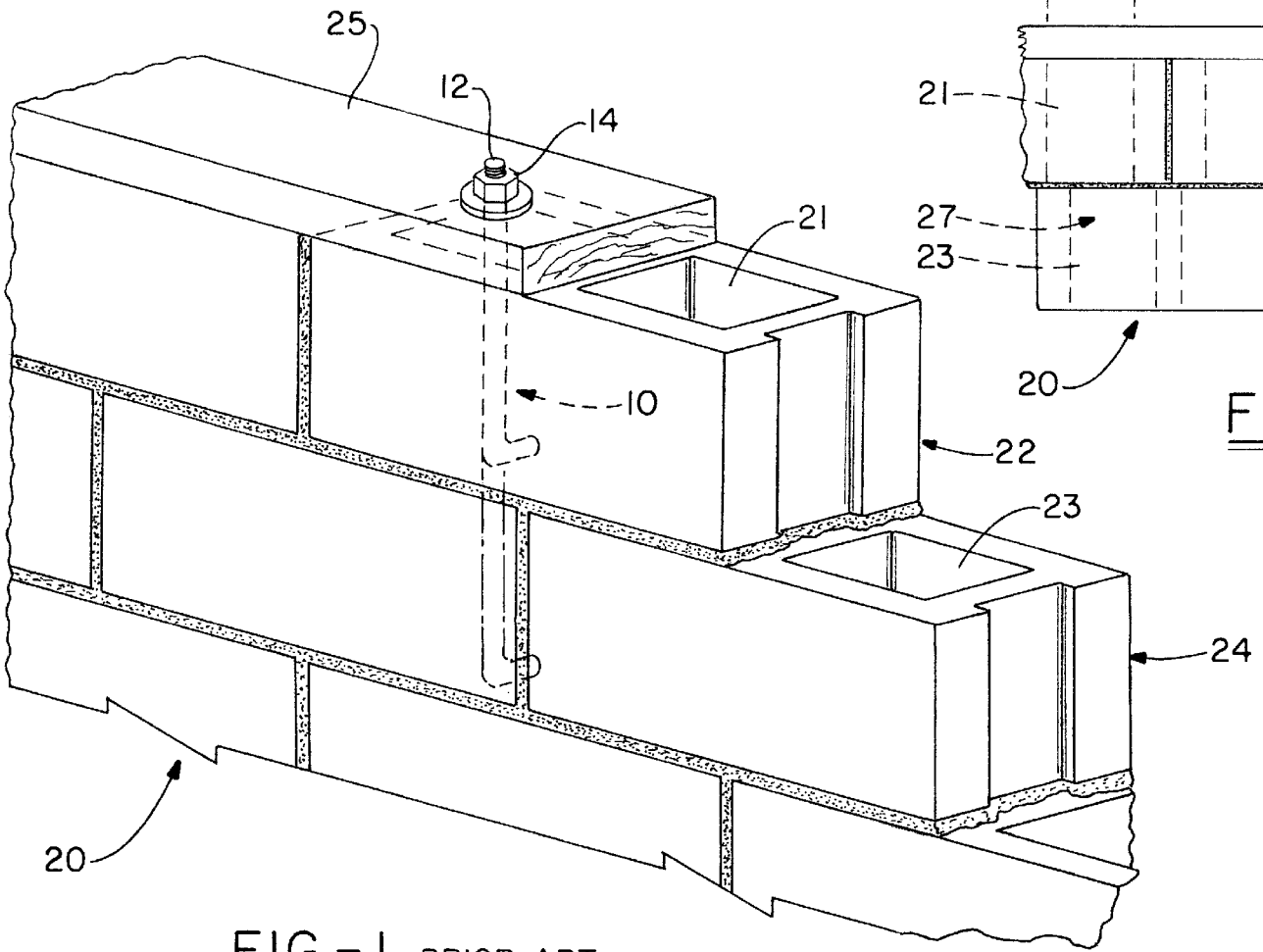
FIG.-1 PRIOR ART
FIG. 1 is a partial perspective view of a conventional cement block foundation wall illustrating the positioning of an anchor bolt within the wall.

Referring to the drawings, FIG. 1 shows an anchor bolt (10) permanently secured within a construction block wall (20). The anchor bolt (10) is shown to extend one or two courses down into wall (20) as previously described. Under many current regulations, the bolt (10) extends down through a top course or layer of blocks (22) and a second course or layer of blocks (24) which form the top two layers of wall (20). The upper end (12) of bolt (10) extends above the top layer (22) of wall (20) and through a hole drilled in sill or frame (25). The upper end (12) of bolt (10) is threaded to accept nut (14) so as to secure sill or frame (25) to wall (20). In FIG. 2, there is shown the relationship between the construction blocks in the courses of wall (20), with a core (21) in top course (22) and core (23) in second course (24) through which bolt (10) extends within wall (20). Construction block walls are typically constructed as seen in FIGS. 1 and 2 wherein the cores (21) and (23) are partially aligned and form a channel or conduit (27) down through all the courses of wall (20). The core of a construction block as shown in FIG. 2 has a width "a" while the conduit (27) will have a width "b" due to overlapping of blocks in each course (22) and (24). As an anchor bolt (10) is inserted down through the core of at least one course of blocks, it is difficult to properly position and secure the bolt (10) in a substantially vertical position and with its upper end (12) extending to a height which will be above the later installed sill (25) to allow proper fastening. It is also difficult to position the bolt (10) at approximately the centerline of sill (25).

Figure 3A:
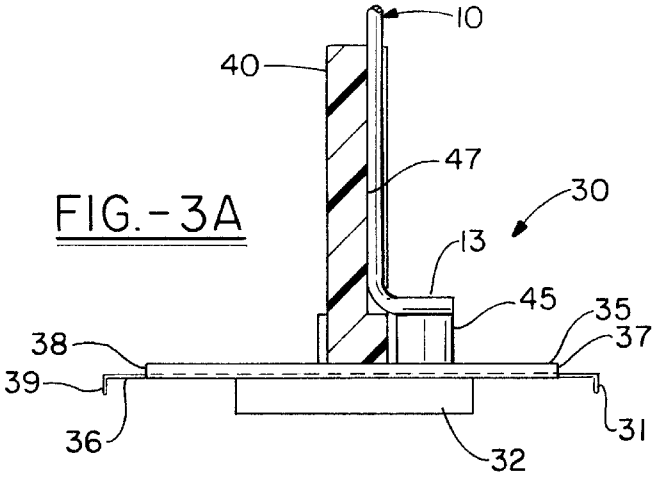
FIG. 3A is a side elevational view of an alternative embodiment of the invention.
Figure 3:
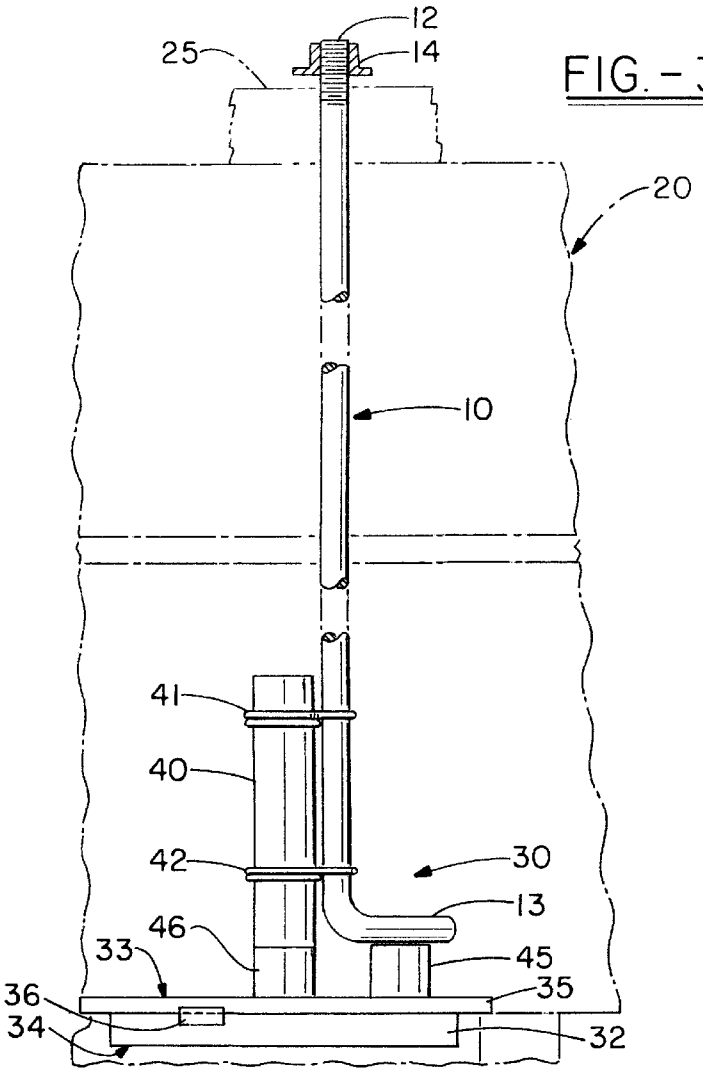
FIG. 3 is a side elevational view of a first embodiment of the present invention including an anchor bolt secured thereto, as positioned within a block foundation wall.

The present invention as shown generally at (30) in FIG. 3 is designed to solve the above and other problems associated with positioning and securing anchor bolts within a construction block wall. Although the invention is shown primarily as being used to position an anchor bolt so that it travels down through the cores of the top two courses of a construction block wall, those skilled in the art will recognize that the present invention may be used to position an anchor bolt, of appropriate length, so that it travels through any number of courses including the top course only. Anchor bolts are generally manufactured of steel in standard lengths which correspond to the number of courses through which the bolt is designed to travel.

Figure 4:
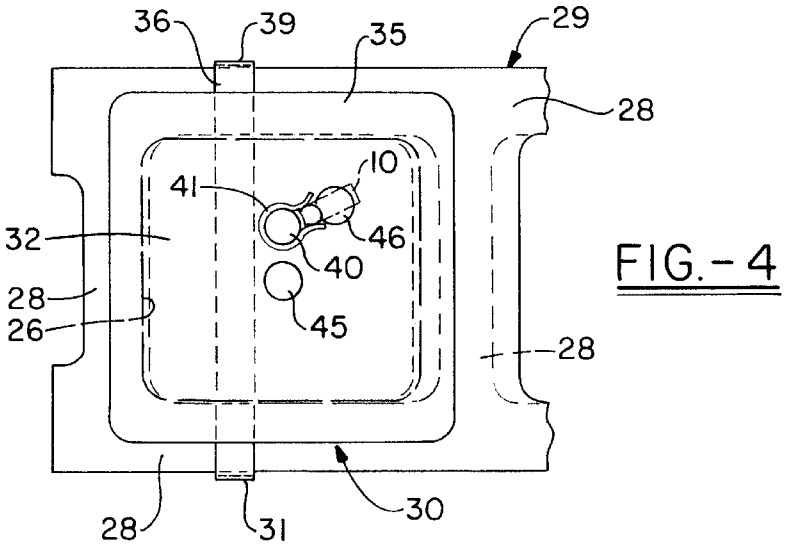
FIG. 4 is a top view of the embodiment shown in FIG. 3 as it is positioned within a vertical core of a cement construction block.
Figure 5:
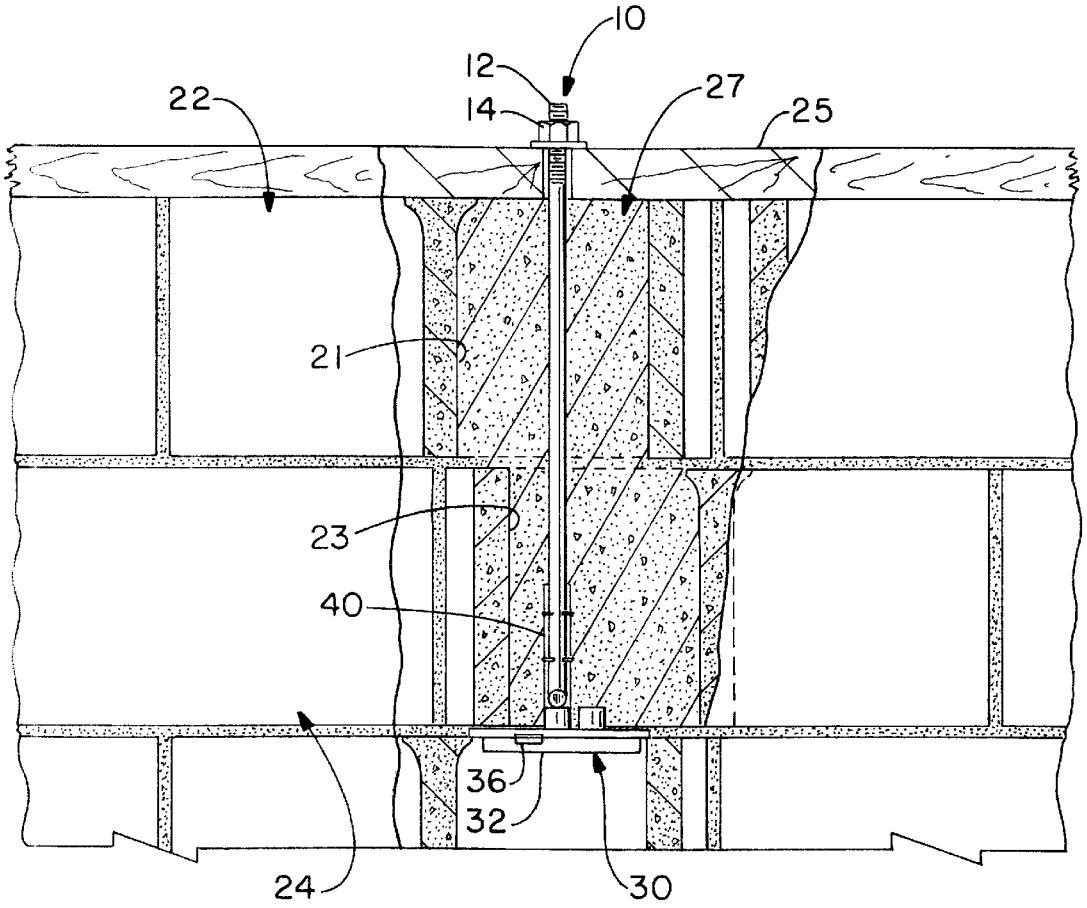
FIG. 5 is a partial elevational view of the top of a construction block wall with portions being broken away illustrating the application of the present invention.

In FIGS. 3, 4, and 5, a first preferred embodiment of the apparatus (30) comprises a base (32) manufactured from wood, plastic, or other substantially rigid material. In this embodiment, the base (32) has dimensions such that it fits within the core of a standard construction block. As standard construction blocks may have slightly smaller or larger cores relative to one another, base (32) is configured to accommodate these variations. Base (32) has an upper surface (33) and a lower surface (34). Upper surface (33) is provided as an outwardly extending flange (35). Flange (35) is designed fit in the mortar area (28) between two stacked construction blocks, with base (32) extending into the core (26) of the block (29) upon which base (32) is rested. Flange (35) is designed to cover or plug at least a substantial portion of core (26) when base is placed on block (29) so that when cement is subsequently poured around bolt (10), it will not run down through channel (27).

In the preferred embodiment, an indicator (36) made from a thin strip of metal or plastic or similar material extends outwardly from first and/or second sides (37) and (38) of base (32), and is of sufficient length on at least one side to extend out through mortar area (28) of wall (20). In FIG. 4, it is seen that the indicator (36) extends out both sides of the block (29) so as to be visible exterior to block (29). Further, a first end (31) or second end (39) of indicator (36) may be bent downward at predetermined positions so that indicator has a width which roughly corresponds to the width of block (29) upon which base (32) is placed. This will assist in properly positioning base (32) on block (29), and will prevent movement of the apparatus (30) once positioned. The primary purpose of indicator (36) is to provide a visual indication, external to wall (20), for a building inspector or other person to verify that an anchor bolt (10) has in fact been properly positioned within wall (20) to the required depth. It should be recognized that indicator (36) may extend from only the first side (37) or the second side (38) of base (32) as desired. The apparatus (30) further includes an upwardly extending post (40) having means to engage an anchor bolt (10), such as a first clip (41) and a second clip (42) positioned along the height of post (40). The clips (41) and (42) or other suitable means releasably engage a conventional anchor bolt (10) to secure it within apparatus (30). In the preferred embodiment, the base (32) will include means for positioning the bolt (10) in a predetermined position relative to the top block (22) and its core (21) so as to be properly positioned relative to the sill of from (25) to be subsequently installed. For example, a first positioning means (45) will properly position an anchor bolt (10) relative to said base (32) in a first embodiment position. The means (45) may be a peg extending from upper surface (33) of base (32) in a first predetermined position. In practice, the anchor bolt (10) is removably secured adjacent to post (40) by clips (41) and (42) so that lower end (13) of anchor bolt (10) preferably rests on peg (45). In this position, the anchor bolt (10) is easily and accurately positioned to extend along the center line of the block wall (20). The bolt (10) extends to a predetermined height to tie in the sill or frame (25). As the positioning of bolt (10) is very accurate, the location of each bolt along the foundation wall is known to facilitate subsequently tying in the sill or frame (25). In the preferred embodiment, clips (41) and (42) are rotatably mounted on post (40) relative to base (32) so that lower end (13) of anchor bolt (10) may alternatively rest on second or further positioning means (46) to position the bolt (10) at a different location. As mentioned, the first positioning means (45) may be located so that when lower end (13) of anchor bolt (10) is rested thereon, upper end (12) of anchor bolt (10) will properly pass through centerline of a standard size sill (25) which is typically a "two by six" or "two by eight" board. Certain situations may require a builder to use a "two by four" as an alternative sill (25). In this situation, clips (41) and (42) are rotated so that lower end (13) of bolt (10) rests on second or further positioning means (46). In this alternative position, the upper end (12) of bolt (10) may be positioned so that it will travel through approximately the centerline of the alternative sill (25) or "two by four." It should be recognized that additional positioning means may be used to position the upper end (12) of bolt (10) at any desired predetermined position. Also, other means may be used to properly locate the lower end (13) of bolt (10), with pegs (45) and (46) being one possible embodiment. Additionally, those skilled in the art will recognize that many different means exist for securing bolt (10) to base (32). The invention is not meant to be limited to clips or one particular variety of clips. As seen in FIG. 3A for example, an alternative embodiment replaces clips (41) and (42) by forming post (40) from molded plastic or other suitable material as is known in the art so as to form slot (47) which is capable of releasably receiving bolt (10) with a snap fit or otherwise.

As seen in FIG. 5, the apparatus (30) allows an anchor bolt (10) to be easily and accurately positioned at a predetermined position relative to wall (20). Thereafter, cement is poured into the conduit (27) around the bolt (10) as positioned in apparatus (30). The apparatus (30) plugs the conduit (27) so the minimal amount of cement can be used to anchor the bolts (10) in wall (20).

Figure 7:
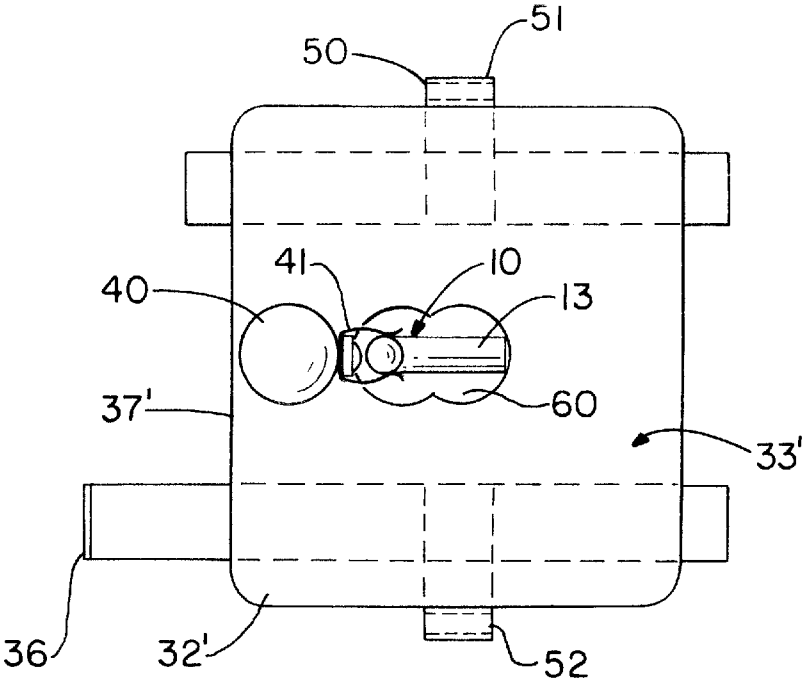
FIG. 7 is a top view of the embodiment shown in FIG. 6 with an anchor bolt secured thereto.
Figure 6:
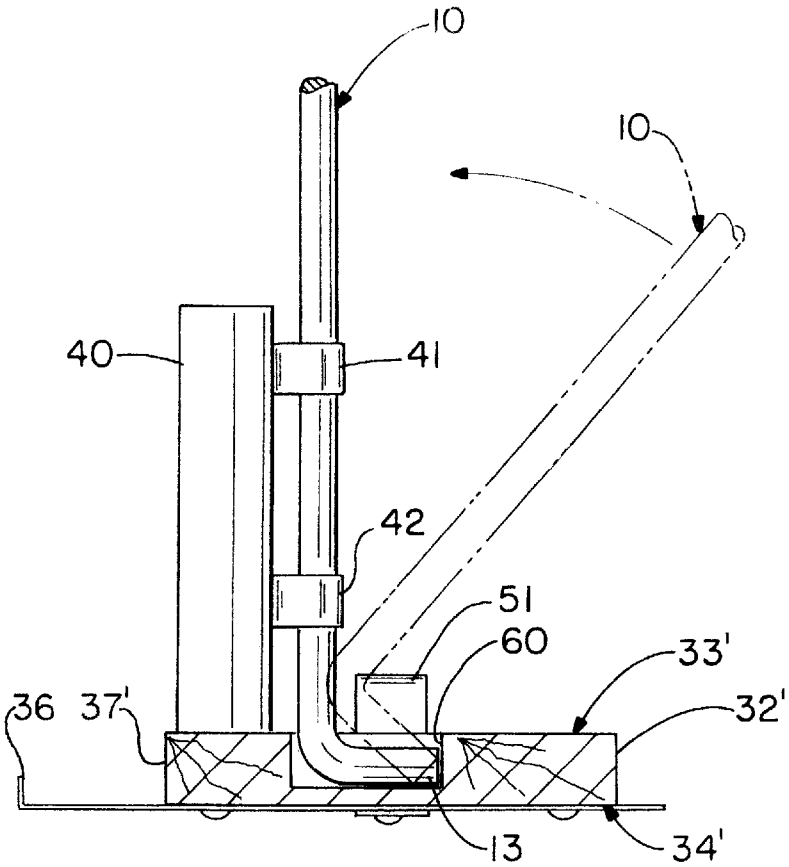
FIG. 6 is side elevational view, in partial cross-section, showing an alternative embodiment of the present invention.
Figure 8:
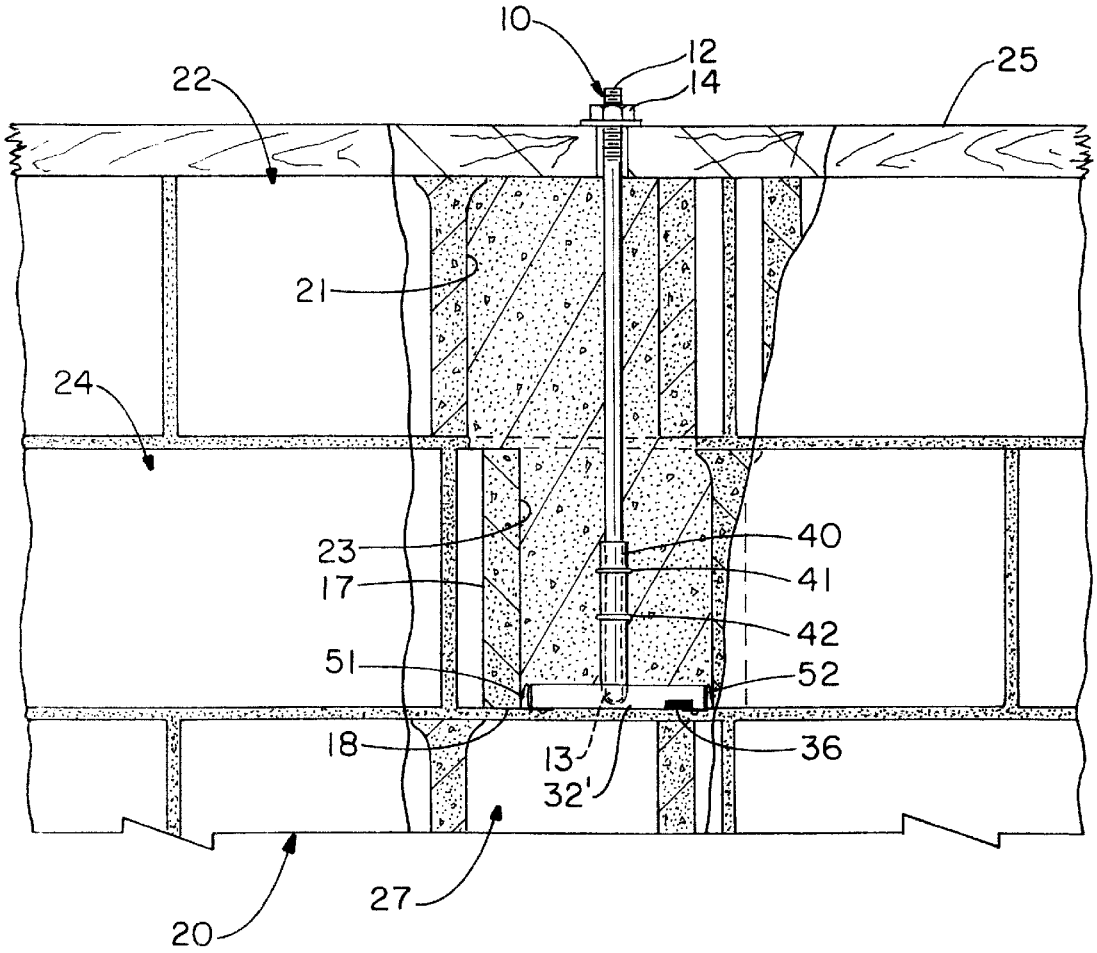
FIG. 8 is an elevational view of the embodiment of FIG. 6 disposed within a construction block wall having portions broken away to illustrate the application of this embodiment.

FIGS. 6, 7, and 8 illustrate another alternative embodiment wherein base (32') is formed with dimensions which allow it to fit and be secured within a core (23) of a construction block (17). For example, base (32') may be positioned so that its lower side (34') is substantially flush with lower edge (18) of block (17) or at another predetermined position relative to wall (20). Most manufactured cement construction blocks have two vertical hollow cores which tend to be somewhat tapered from the bottom upwards. This tapering creates a wedging effect upon insertion of base (32') into the core, such that it cannot be pulled upwards through the block. One or more tabs (50) may extend from at least one side of base (32'), acting to position base (32') in a predetermined position within the block core, for example by preventing base (32') from being pulled or pushed too far into core (23). Additionally at least one means to retain base (32') in this position within core (23) may comprise first and/or second spring clips (51) and (52) disposed on opposing sides of base (32'). The at least one spring clip (51) and/or (52) act to frictionally secure base (32') within core (23). In this embodiment, the base (32') has a slot or channel (60) acting as a bolt positioning means. The slot (60) is formed in upper surface (33') of base (32') to receive lower end (13) of bolt (10). Bolt (10) is releasably secured in a substantially vertical position adjacent to post (40) by suitable means such as first clip (41) and second clip (42). An indicator (36) can again extend from a side (37') of base (32'), which is of sufficient length to extend out through mortar area (28) of wall (20) to externally indicate the presence of the base (32') within the wall (20). FIG. 8 shows the anchor bolt (10) as secured in the proper position within the wall (20) and cemented in place.

It will be apparent to those skilled in the art that various modifications and variations can be made in the present invention and in its construction without departing from the scope or spirit of the invention. Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An apparatus, for positioning an anchor bolt, within a construction block wall comprising:

a base being selectively positioned in a predetermined location within a construction block wall intermediate a top and bottom of said construction block wall, said base having an upper surface, a lower surface; and securing means associated with said upper surface of said base for releasably securing an anchor bolt to said base in a predetermined position such that said bolt is positioned at a predetermined location relative to said top of said construction block wall.

2. An apparatus as recited in claim 1, wherein said base includes a flange of sufficient size to be selectively supported on said at least one construction block, said block having a core with said flange extending to be supported on said block adjacent said core.

3. An apparatus as recited in claim 1, wherein said securing means for releasably securing said anchor bolt comprises an upwardly extending member to which said anchor bolt is selectively attached to position said bolt in a substantially vertical orientation.

4. An apparatus as recited in claim 3, wherein said upwardly extending member comprises at least one clip to releasably engage said anchor bolt.

5. An apparatus as recited in claim 3, wherein said means for securing said anchor bolt adjacent to said post comprises at least one slot formed integral to said post designed to releasably engage said anchor bolt.

6. An apparatus as recited in claim 1, further comprising at least one positioning means, associated with said upper surface of said base, for properly positioning said anchor bolt in a predetermined position relative to said base.

7. An apparatus as recited in claim 6, wherein said at least one positioning means comprises at least one upwardly extending support on said upper surface of said base, said at least one support providing a lower supporting surface on which the bottom of said anchor bolt is supported.

8. An apparatus as recited in claim 1 further comprising indicator means, extending outwardly from at least one side of said base a sufficient distance to extend to the exterior surface of said wall, for indicating, external to a construction block wall, the presence and position of said base within said wall.

9. An apparatus as recited in claim 1, wherein said base is configured to cover at least a substantial portion of a core opening of a construction block of said construction block wall to substantially prevent a compound poured into said core opening from passing by said base.

10. An apparatus as recited in claim 1, wherein said base comprises means which engage the side wall of a core associated with a construction block for frictionally securing said base within said core.

11. An apparatus as recited in claim 10, wherein said means for frictionally securing said base comprises at least one spring clip.

12. An apparatus as recited in claim 1, wherein said means for releasably securing said anchor bolt comprises a post, extending from said upper surface of said base, having at least one means for securing said anchor bolt adjacent to said post.

13. An apparatus as recited in claim 12, wherein said means for securing said anchor bolt adjacent to said post comprises at least one clip to releasably engage said anchor bolt.

14. An apparatus as recited in claim 12, wherein said means for securing said anchor bolt adjacent to said post comprises at least one slot formed integral to said post designed to releasably engage said anchor bolt.

15. An apparatus as recited in claim 1, wherein said securing means is at least one slot, formed in said base, for receiving a lower end of said anchor bolt.

16. An apparatus, for positioning an anchor bolt, within a construction block wall comprising:

a base being selectively positioned in a predetermined location within a construction block wall and relative to at least one construction block forming said wall, said base having an upper and lower surface;

securing means associated with said upper surface of said base for releasably securing an anchor bolt to said base in a predetermined position such that said bolt is positioned at a predetermined location relative to said construction block wall; and means extending from said base for locating said lower surface of said base at a desired position relative to a predetermined surface of said construction block.

17. An apparatus as recited in claim 16, wherein said securing means for releasably securing said anchor bolt comprises an upwardly extending member to which said anchor bolt is selectively attached to position said bolt in a substantially vertical orientation.

18. An apparatus as recited in claim 16, further comprising at least one positioning means, associated with said upper surface of said base, for properly positioning said anchor bolt in a predetermined position relative to said base.

19. An apparatus as recited in claim 16, wherein said base is configured to cover at least a substantial portion of a core opening of a construction block of said construction block wall to substantially prevent a compound poured into said core opening from passing by said base.

* * * * *